US009257253B1

(12) United States Patent
Allen et al.

(10) Patent No.: US 9,257,253 B1
(45) Date of Patent: Feb. 9, 2016

(54) SYSTEMS AND METHODS UTILIZING A TRIODE HOLLOW CATHODE ELECTRON GUN FOR LINEAR PARTICLE ACCELERATORS

(71) Applicants: Curtis G. Allen, Menlo Park, CA (US); Christopher P. Ferrari, Menlo Park, CA (US); Adam J. Mitchell, Menlo Park, CA (US)

(72) Inventors: Curtis G. Allen, Menlo Park, CA (US); Christopher P. Ferrari, Menlo Park, CA (US); Adam J. Mitchell, Menlo Park, CA (US)

(73) Assignee: Altair Technologies, Inc., Menlo Park, CA (US)

( * ) Notice: Subject to any disclaimer, the term of this patent is extended or adjusted under 35 U.S.C. 154(b) by 0 days.

(21) Appl. No.: 14/465,797

(22) Filed: Aug. 21, 2014

(51) Int. Cl.
*H01J 29/70* (2006.01)
*H01J 29/48* (2006.01)
*H01J 29/58* (2006.01)
*H01J 29/56* (2006.01)

(52) U.S. Cl.
CPC ..... *H01J 29/484* (2013.01); *H01J 29/485* (2013.01); *H01J 29/488* (2013.01); *H01J 29/56* (2013.01); *H01J 29/58* (2013.01)

(58) Field of Classification Search
CPC ..... H01J 25/24; H01J 29/485; H01J 29/488
USPC ..... 313/449, 414, 441
See application file for complete search history.

(56) References Cited

U.S. PATENT DOCUMENTS 8,258,725 B2 * 9/2012 Ferguson ..... H01J 25/14 315/404

* cited by examiner

*Primary Examiner* — Vip Patel
(74) *Attorney, Agent, or Firm* — Kang S. Lim

(57) ABSTRACT

The present invention generally relates to systems and methods for generating controllable beam of electrons using a hollow-cathode triode electron gun that substantially mitigate impact of back-streaming electrons.

24 Claims, 4 Drawing Sheets

SYSTEMS AND METHODS UTILIZING A TRIODE HOLLOW CATHODE ELECTRON GUN FOR LINEAR PARTICLE ACCELERATORS

BACKGROUND

The present invention relates to systems and methods for generating controllable beam of electrons using a hollow cathode triode electron gun that substantially mitigates the impact of back-streaming of the electrons.

A vacuum electron device (VED), such as a linear particle accelerator or a Klystron, uses a source of an electron beam which is typically known as an electron gun.

Conventional electron guns are of two types. The first type of electron guns is the diode electron gun which has two electrodes; namely a cathode and an anode. The second type of electron guns is the triode electron gun which has three electrodes; namely a cathode, an anode, and a grid.

The triode electron gun has operational advantages over the diode electron gun. One advantage is allowing for fast changes in the electron beam current produced by the electron gun. In the case of the diode electron gun, changing the electron beam current is done by changing a high-voltage difference between the cathode and the anode which is normally thousands of volts. In the case of the triode electron gun, changing the electron beam current is done by changing a voltage difference between the cathode and the grid which is normally a few or less than 100 volts. Thus, changing the electron beam current can be done faster and in a more controlled way.

A major use of a triode electron gun is to supply electron beam current to a linear particle accelerator (Linac). A common problem associated with Linacs is that some electrons entering the Linac's RF Structure are out of synchronism with the RF (electromagnetic energy) and are reflected back towards the electron gun at accelerated velocities and this is commonly called back-streaming electrons. These back-streaming electrons impact its cathode and raise its temperature. The cathode is normally impregnated with a material, such as Barium, that enhances electron emission by lowering the cathode's work function. The rise of the cathode temperature increases the evaporation rate of the impregnating material. Over time this same impregnate material adheres to all surfaces that are line-of-sight, mainly the gun's grid which is directly in front of the cathode's emitting surface. The grid is kept at a voltage very near the same potential voltage as the cathode and thus sees a voltage gradient between it and the anode which is at ground potential. The back-streaming electrons impact the grid, raising its temperature. With the deposit of the impregnating material on the grid and the rise of its temperature due back streaming of electrons, the grid can emit unwanted electrons and in an uncontrolled way.

The back-streaming electrons also impact the center portion of the cathode's emitting surface, raising its temperature and consequently increasing the evaporation rate of the impregnating material. This excess impregnating material will adhere to the grid and can lead to unwanted emission due to high DC field gradients and will also adhere to other line-of-sight surfaces, including the Linac's RF structure that is down-stream from the cathode. The Linac structure also has high RF field gradients and when its surfaces become coated with the impregnating material it would experience field emission of unwanted and uncontrolled electrons which form what is commonly known as "dark current."

It is therefore clear that an urgent need exists for an improved electron gun that is a triode and can substantially mitigate impact of back-streaming of the electrons and addresses the above described problem of the emission of unwanted and uncontrolled electrons. The present invention is concerned with a triode electron gun. Particularly, relates to a triode electron gun with hollow cathode used with vacuum electron devices (VED's).

SUMMARY

A vacuum electron device (VED), such as a linear particle accelerator (Linac) or a Klystron, uses a source of an electron beam which is typically known as an electron gun. A typical triode electron gun is comprised of a cathode to emit electrons, an anode to attract and focus these electrons and a grid to control and/or modulate the flow of the electrons.

When the electron gun is used with a VED such as a Linac, some electrons emitted from the cathode of the electron gun, that enter the RF structure, can stream back towards the electron gun impacting the grid and cathode, causing the grid and cathode temperature to rise above their normal operating temperatures. This results in a shorter life for the electron gun, by increasing the evaporation rate of the cathode's impregnating material and it causes the grid to also emit unwanted electrons that will be detected as high-voltage DC leakage current and unwanted and uncontrolled electrons commonly known as "dark current" producing unwanted radiation exiting the Linac.

The present invention mitigates the adverse effect of the back-streaming electrons by using a hollow cathode and a hollow grid in the triode electron gun and including a post as an integral part of the hollow cathode electron gun. Inclusion of the post is an essential feature of this present invention that helps eliminate the emission of unwanted and uncontrolled electrons and in the same time providing for a well behaved converging electron beam.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

Figure 1:
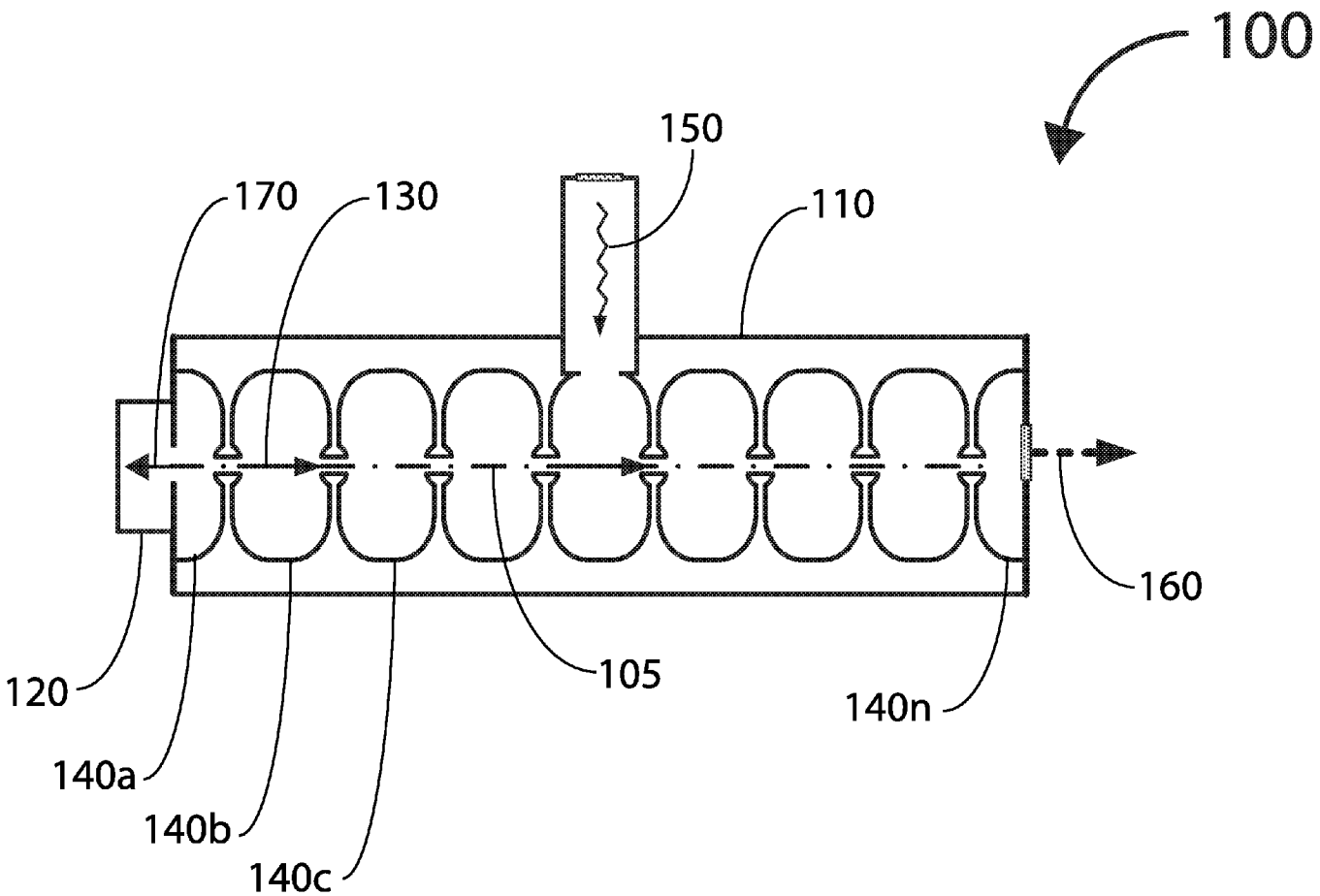
FIG. 1 is a basic schematic of an linear particle accelerator with an electron gun.

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute and/or sequential terms, such as, for example, "will," "will not," "shall," "shall not," "must," "must not," "first," "initially," "next," "subsequently," "before," "after," "lastly," and "finally," are not meant to limit the scope of the present invention as the embodiments disclosed herein are merely exemplary.

In addition, as used in this specification and the appended claims, the singular article forms "a," "an," and "the" include both singular and plural referents unless the context of their usage clearly dictates otherwise. Thus, for example, reference to "a piston" includes a plurality of springs as well as a single piston, reference to "an outlet" includes a single outlet as well as a collection of outlets, and the like.

A common problem associated with the use of electron guns with linear particle accelerator is that some electrons are injected into the accelerator out of phase with the RF and are accelerated backwards towards the electron gun's grid and cathode. These back-streaming electrons can have significant energy and impact the grid and cathode causing the grid and cathode temperature to rise above their normal operating temperatures. The area of impact is usually spread over the centermost region of the grid and cathode's emitting surface resulting in a predominantly higher temperature in those regions, but also causing the entire surfaces to increase in temperature as well. The cathode is normally impregnated with a material that includes Barium, which enhances electron emission by lowering the cathode material's work function. The evaporation rate of the Barium is strongly dependent on the cathode temperature and the rise of the cathode temperature due to back-streaming electrons quickly increases the evaporation rate of the impregnating material. Over time, this same evaporated impregnate material adheres and builds-up to all surfaces that are line-of-sight, which include but are not limited to the electron gun's grid which is normally positioned directly in front of the cathode's emitting surface, the electron gun's anode and the accelerating structure of the Linac. The grid also sees a voltage gradient between it and the anode which is normally at ground potential. The grid's potential is close to the potential voltage of the cathode. The back-streaming electrons impact the grid and cause its temperature to rise. With the deposit of the impregnating material on the grid and the rise of its temperature due to back streaming of electrons, the grid will begin emitting unwanted electrons and in uncontrolled way.

The back-streaming electrons also impact the center portion of the cathode's emitting surface, raising its temperature and consequently increasing the evaporation rate of the impregnating material. This excess impregnating material will adhere to the grid and other surfaces, including the Linac structure that is down-stream from the cathode. The Linac structure also has high field gradients and when its surfaces become coated with the impregnating material, it would experience high-field emission of unwanted and uncontrolled electrons which form what is commonly known as "dark current" in the Linac.

Dark current is particularly problematic for Linac's electron radiation applications, where small amounts of current (of the order of hundreds of micro-amps) are used and therefore small amounts of unwanted and uncontrolled emission of electrons can significantly change the planned-for electron radiation.

One solution that can be used on triode electron guns is the coating (for example, by sputtering) the electron gun's grid (which is made of Molybdenum (Mo), as an example) with a material such as Zirconium (Zr) whereby the Zr reacts chemically with a impregnating material, such as Barium, deposited on the grid to inhibit the unwanted and uncontrolled emission of electrons from the grid. However, in this approach the center regions of the grid and the cathode still get very hot due to the impact of back-streaming electrons and the presence of excessive impregnating material from the cathode to the RF Structure will lead to dark current. Also, as the back-streaming electrons impact the center portion of the cathode's emitting surface and thus raising its temperature, there will be increase in the evaporation rate of the impregnating material and consequently, the useful life of the cathode becomes shorter.

An alternative approach to address the issue of back-streaming electrons and the associated problem of dark current is used with diode electron guns (which have only two electrodes, a cathode and an anode and no grid). In this approach, a hollow-cathode is employed together with a center post that is thermally isolated from the cathode. In this configuration, the back-streaming electrons would miss the cathode and instead impact the post. In a diode electron gun the cathode is pulsed from zero (ground potential) to full cathode potential (normally kilo volts) when electron flow is wanted. Although the post will get coated with impregnating material, such as Barium, and experience increased heat from the back-streaming electrons, when the cathode and post are pulsed off at zero volts, there is no DC field gradient and no unwanted electron flow between pulses. The post is not impregnated, but a very small amount of cathode's impregnating material, such as Barium does adhere to it and can be liberated, but at such a small amount that no meaningful amount of dark current is created. However, this approach is limited to diode electron guns.

On a triode electron gun, the cathode remains at full potential voltage and the grid voltage is pulsed positively, with respect to the cathode, to allow and/or enhance electron flow from the cathode and pulsed negatively with respect to the cathode to inhibit electron flow from the cathode. The use of triode electron guns has important advantages over diode electron guns. One example is when a triode electron gun is used to provide an electron beam to a Linac. The use of a triode gun allows for ultra-fast current pulsing, much faster than that of a diode electron gun, and the faster pulse repetition rate facilitates faster inspections in industrial screening applications. The use of a triode electron gun also allows for ultra-fast changes in beam current in the Linac which lends itself to multi-energy Linac operation, which is highly advantageous in industrial screening applications when different energies are needed to discriminate home-made-explosives (HME's) and other forms of contraband. For medical applications, the use of a triode electron gun to provide an electron beam to a Linac would allow the accelerator to operate at multiple energies very similar to industrial Linacs described above. Thus, one accelerator-based system would be able to handle both imaging and a multitude of treatments covering a broad spectrum of patients and types of cancer.

The present invention addresses the above-described problem of the emission of unwanted and uncontrolled electrons. This invention is concerned with a triode electron gun. Particularly, relates to a triode electron gun with hollow cathode used with a vacuum electron device (VED), such as a linear particle accelerator or a Klystron, wherein the Klystron can be a single-beam klystron or a multi-beam klystron.

The hollow cathode triode electron gun of this invention can also have advantageous use as a source of electrons for a multiple of devices that requires an electron beam.

The hollow cathode triode electron gun according to one embodiment of the present invention can be used with many types of Linacs for medical, industrial, and security applications. This includes: standing wave Linacs and traveling wave Linacs. The standing wave Linacs can be of the bi-periodic axially coupled type or the magnetically side-coupled type or the bi-periodic magnetically coupled type.

Also the hollow cathode triode electron gun according to one embodiment of the present invention can be used with deferent Linac designs such as Linacs designed based on the constant impedance approach or Linacs designed based the constant gradient approach.

The present invention represents a practical solution to the above-described problem based on a triode electron gun employing a hollow cathode, a post and a grid with a center hole to receive the post. Incorporating a grid with a hollow cathode provides the benefits of using a triode electron gun without the disadvantages that a grid or cathode suffers due to heating caused by the impact of back-streaming electrons.

One embodiment of this invention is also concerned with a shadow gridded electron gun which is basically, a triode electron gun having a shadow grid connected directly to the cathode in addition to the control grid.

Using incorporated figures, the present invention of the hollow cathode triode electron gun is described hereafter in more detail.

FIG. 1 shows a basic schematic 100 of an exemplary linear particle accelerator (Linac) 110 with an electron gun 120 emitting an electron beam 130 along an axis 105 which is the common axis for both the electron linear accelerator 110 as well as the electron gun 120. The electron beam 130 is being accelerated through cavities 140*a*, 140*b*, 140*c*, . . . , 140*n* which are powered by microwave power 150, also known as RF power or electromagnetic power. The exemplary electron linear accelerator 110 thus produces a high-energy electron beam 160 as its output. It is to be noted that some of the electrons emitted from the electron gun 120 can arrive in the cavities of the electron linear accelerator at a wrong phase and thus they form a back-streaming electron beam 170.

Figure 2:
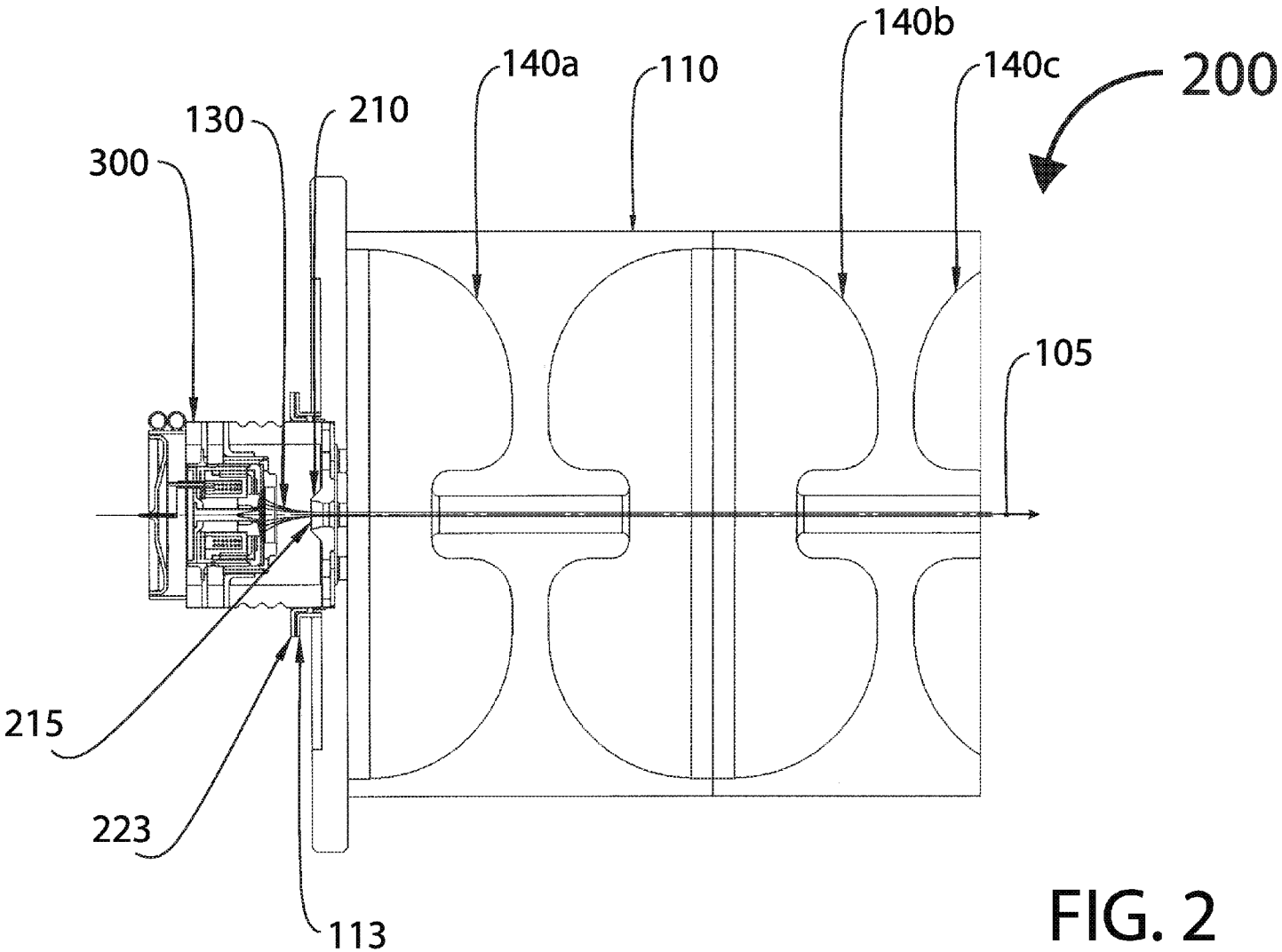
FIG. 2 depicts a cross-sectional view of a hollow cathode electron gun with a post and a few cavities of the linear particle accelerator.

FIG. 2 depicts a cross-sectional view 200 of a hollow cathode electron gun 300 according to the present invention which is emitting the electron beam 130 along the axis 105 towards an anode 210 which is connected mechanically and electrically to the exemplary Linac 110. The electron beam 130 passes through a center aperture 215 in the anode 210 onto the Linac 110. Only the first three cavities 140*a*, 140*b* and 140*c* of the electron linear accelerator are shown. The center of anode aperture 215 is aligned with the axis 105 which is the common axis for both the hollow cathode electron gun 300 and the Linac 110. The hollow cathode electron gun 300 is affixed to the Linac 110 by mating a weld flange 223 of the hollow-cathode electron gun 300 to a weld flange 113 of the Linac 110.

Figure 3:
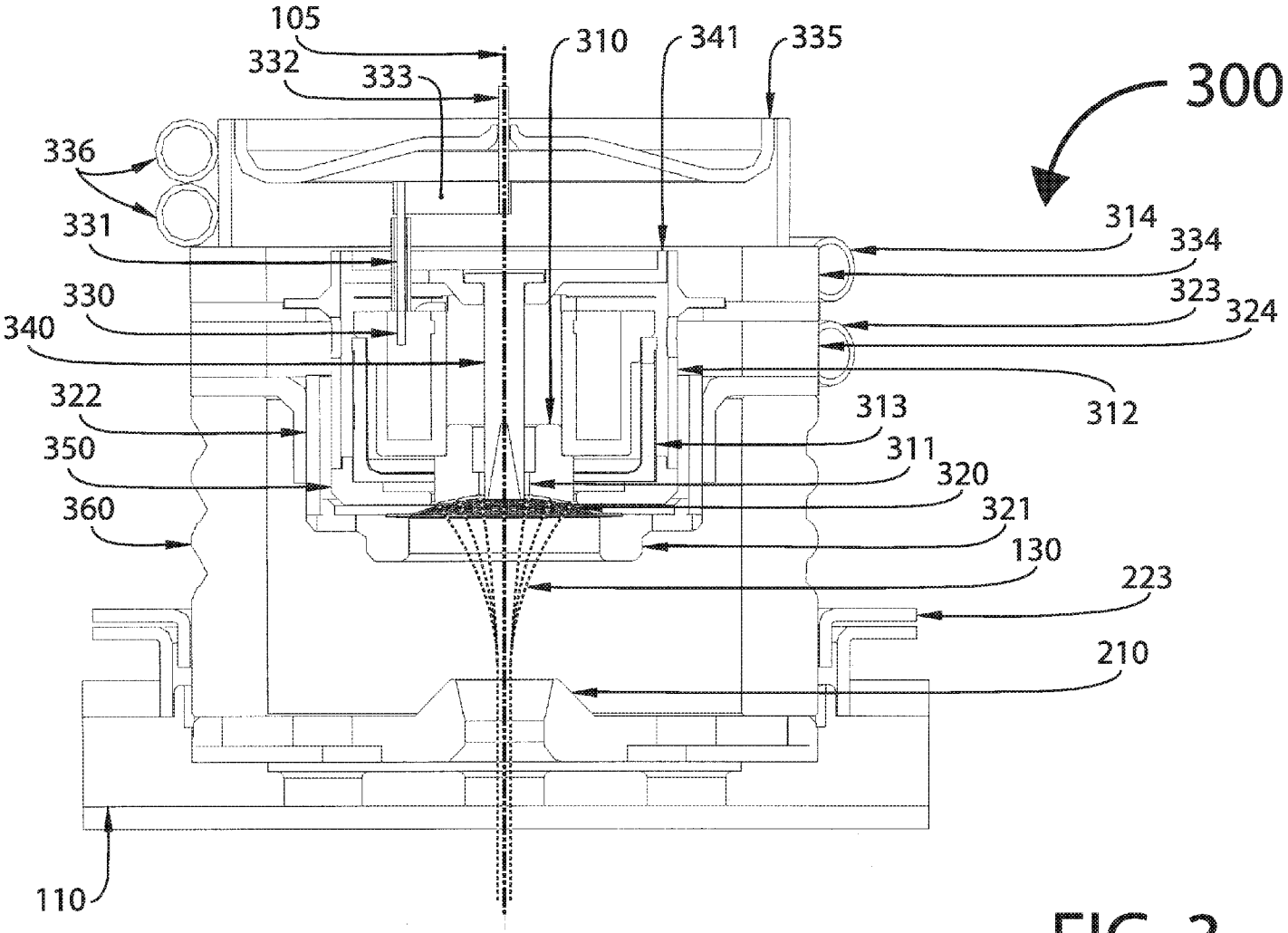
FIG. 3 is a detailed cross-sectional view of the hollow cathode electron gun with the post.

FIG. 3 depicts details of the hollow cathode electron gun 300 according to the present invention. The hollow cathode electron gun 300 is comprised of a hollow cathode 310, a grid 320, a heating filament 330, a post 340, a focusing electrode 350, and a high-voltage insulator 360 enclosing all the hollow-cathode electron gun's constituent components and all are centered on the axis 105 which is the common axis for both the hollow cathode electron gun 300 and the Linac 110 (only the edge of the accelerator is shown). Each of the hollow cathode electron gun 300 constituent components is described hereafter in more detail.

The hollow cathode 310 is of concave shape and has a center hole 311 which is centered on the axis 105. The hollow cathode 310 is made of a material, such as impregnated porous Tungsten, that can emit electrons easily when heated to elevated temperatures (thermionic emission). The hollow cathode is normally impregnated with a material, such as Barium, that enhances electron emission by lowering the cathode material's work function. The hollow cathode 310 is affixed in place by a cathode support 312 or series of support structures. The cathode support 312 is typically a metal tube, cylinder and/or conical cylinder made of Molybdenum, Molybdenum-Rhenium, Tantalum or similar low vapor pressure material also centered on the emission axis 105. The cathode support 312 is connected to a focus electrode 350 and also a cathode support sleeve 313 which is typically made of Molybdenum or Molybdenum-Rhenium or other suitable low vapor pressure material, which acts to as a thermal choke, keeping the heat generated by the heating filament 330 from being thermally conducted away from the hollow cathode 310 allowing the hollow cathode to achieve and maintain high temperature operation that can be greater than 1000 C for an impregnated dispenser cathode. Similar structures are used to maintain high temperatures in coated cathodes, oxide cathodes, reservoir cathodes and other types of cathodes used in electron guns. The cathode support 312 is attached to a cathode connector 314, which is brazed between the cathode-to-grid insulator 324 and the filament insulator 334. The cathode support 312 is also welded to a post support 341 and the post support is welded to the post 340 keeping it centered on axis 105 and held in this centered position relative to the hollow cathode 310, the grid 320 and the anode 210. The hollow cathode 310 is connected to a power supply (not shown) through the cathode connector 314. The power supply provides the cathode with a biasing negative voltage which is normally of tens of kilo volts.

It is to be noted that according to one embodiment of the present invention, one type of the hollow cathode is a "dispenser B cathode" which is a metal matrix of porous Tungsten impregnated with a mixture of Barium Oxide (BaO), Calcium Oxide CaO, and Aluminum Oxide (2Al2O3) having, for example, the mole-ratio of 5 BaO:3 CaO: 2Al2O3, also known as "5-3-2 impregnation". Other common mole-ratios include 3:1:1, 4:1:1, and 6:1:2. Other impregnation rations can also be used. Another type of dispenser cathode is the "dispenser scandate cathode" which is impregnated with Scandium Oxide (Sc2O). A yet another cathode type according to one embodiment of this invention is a dispenser B cathode with a thin layer of Os—Ru (Osmium-Rhenium), which is known as an "M-coated cathode". A fourth cathode type which can be used according to one embodiment of the present invention is an "oxide cathode".

The grid 320 is of a concave shape as the hollow cathode 310 and is placed in a close proximity, typically as close as a few mils to tens of mils, to the emitting surface of the hollow cathode 310 and having approximately the same curvature of the cathode as needed to achieve the proper emission and beam trajectories 130. The position and shape of the grid 320 as well as its openings are chosen to optimally control the passage of the electrons emitted from the cathode. Grid 320 is secured by a metal supporting tube or cone called a grid support 322, which can be made up of multiple components and is typically Molybdenum and/or the same material as the grid and is centered on the common axis 105. The grid support 322 constitutes an extension of a coaxial cavity, which is centered on the common axis 105. The grid support 322 is fixed in position by welding or brazing to the high voltage insulator 360 typically made from alumina (94%-99.8% pure) and a cathode-to-grid insulator 324 which is also made from alumina and exits the vacuum wall to provide a means of connecting a grid power supply (not shown) to the electron gun 300 at a grid connector 323.

The heating filament 330 is connected to a filament leg 331 which extends from the back of the hollow cathode 310 and is connected to a filament rod 332, typically made from Kovar or Nickel, by a metal conductor ribbon 333 made of Platinum or other suitable metal. The filament rod 332 is welded to a filament cap 335 such that the weld creates a hermetic seal and proper electrical contact with a filament connector 336 that is connected to a filament power supply (not shown). The cathode connector 314 is electrically isolated from the filament connector 336 by an alumina filament-heater isolator 334.

When a current is supplied to the heating filament 330, the filament wire increases in temperature due to resistive heating and the heat from this wire is conducted to the cathode, raising the temperature of the hollow cathode 310 and thus allowing it to emit electrons from its impregnated concave surface. The presence of the focusing electrode 350 keeps unwanted electrons from emitting out the sides of the cathode and also helps focus the emitted electrons, from the face of the cathode, into a properly shaped electron beam having proper electron trajectories 130 along the axis 105.

An essential feature of this invention is the inclusion of the post 340 as an integral part of the hollow cathode electron gun 300. The post 340 is placed at the center of the hollow cathode 310 and is affixed in place by the post support 341 typically made from Kovar or Nickel.

A hollow cathode without a post such as the post 340 in the center of the hollow cathode through its hole will emit less desirable electrons with poor trajectories from its inside diameter. One embodiment of the present invention prevents this effect by adding a solid post such as the post 340 positioned in the center of the hollow cathode 310. The said post can be of cylindrical or conical shape. It is thermally isolated, but electrically connected to the hollow cathode and is therefore at the same potential as the cathode and will therefore inhibit any emission from the cathode's inside diameter. Without such post, the electrons coming off the cathode will have collapsing trajectories under the absence of any space charge in the center of the emitted beam. A post whose potential voltage is the same as the cathode will effectively repel electrons with the same potential voltage and keep the electron beam from collapsing, improving the electron trajectories, providing for a well behaved converging electron beam.

Figure 4:
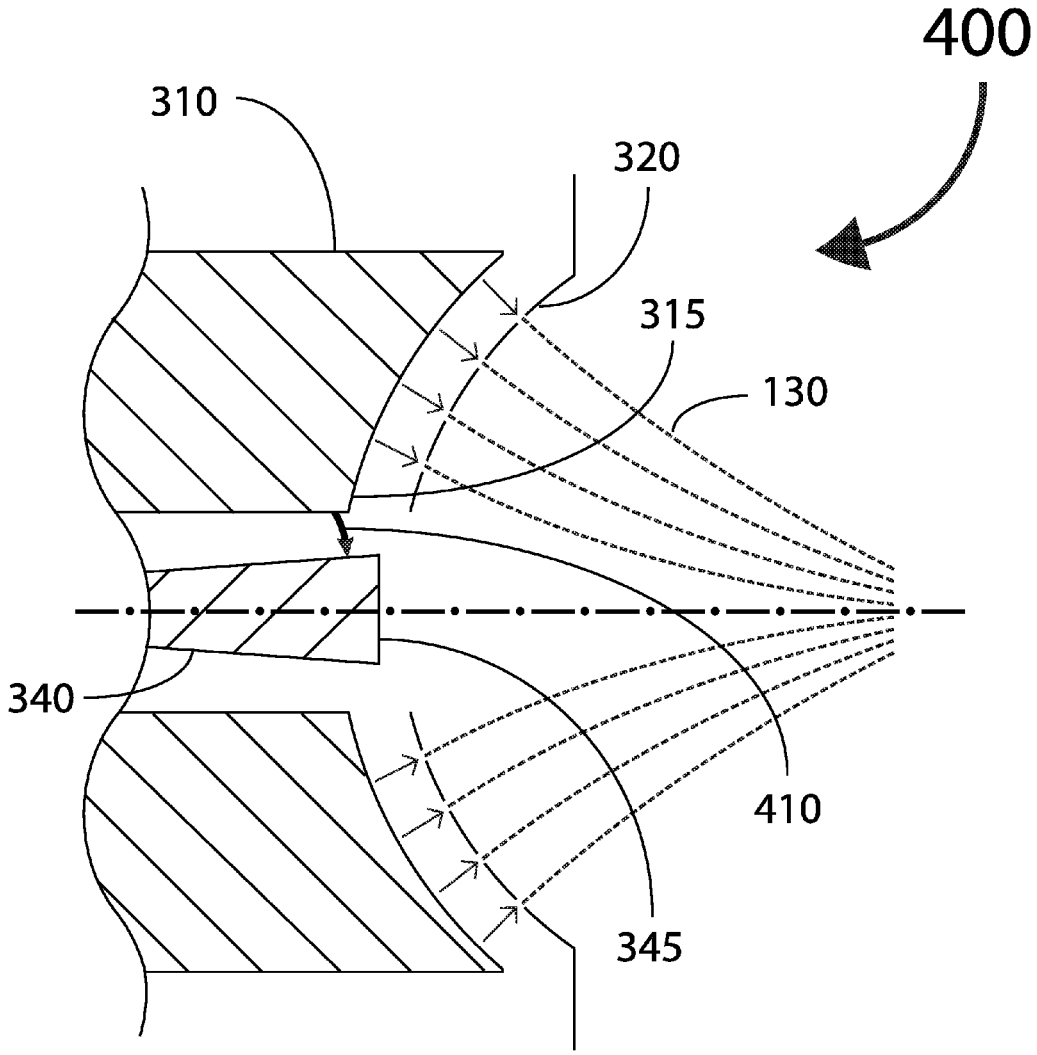
FIG. 4 is a simplified graphical illustration of the role of the post in preventing the collapse of an emitted electron beam in the hollow cathode electron gun.

The configuration 400 in FIG. 4 illustrates the role of the post in preventing the electrons coming off the cathode from having collapsing trajectories. The electron beam is emitted from a surface 315 of the hollow cathode 310. The cathode is normally biased at a negative voltage potential of tens of kilo-volts and the grid 320 is pulsed positively to allow electrons flow from the cathode forming the emitted electron beam 130. The post 340 is positioned in the center of the hollow cathode 310 and according to one embodiment of the invention is electrically connected to the hollow cathode 310. Thus, both the cathode surface 315 and a post surface 345 will have the same potential and therefore inhibit any undesirable emission, such as electron rays 410, from the cathode's inside diameter. A post whose potential voltage is the same as the cathode and that is positioned axially such that the end of the post is in front of the cathode will effectively repel electrons with the same potential voltage and keep the electron beam from collapsing, improving the electron trajectories, providing for a well behaved converging electron beam. The position of the post relative to the grid is also important such that the gap between the two can be full cut-off when the grid is pulsed negatively. Too large a gap will allow the field from the anode to bend inward toward the cathode surface allowing it to bias a small amount of electrons when the beam should be fully turned off.

It is to be noted that in the presence of the impregnated cathode, the post 340 will eventually get coated with the impregnating material, such as Barium, lowering the post's material work function. As the back-streaming electrons impact the post, they will result in an increase in temperature of the post and consequently emission of unwanted and uncontrolled electrons from the post. In one embodiment according to the present invention, the post can be made of a material such as Zirconium (Zr) or Hafnium (Hf) or another metal or composite that reacts with the impregnating material, such as Barium, to inhibit or completely stop emission.

In yet another embodiment of the present invention the post can be made of a material such as Molybdenum, Tungsten or another low vapor pressure material and then coated (for example by sputtering, chemical vapor deposition, or other means of coating) with Zirconium (Zr) or another element that reacts chemically with the impregnating material, such as Barium, to inhibit electron emission.

According to one embodiment of the present invention, the post is thermally isolated from the cathode and has a heat-sink path to keep the post material from melting.

According to one embodiment of the present invention, the post can be shaped as a hollow cylinder or a hollow cone such that the back-streaming electrons will impact the inside of the post over a larger surface area, providing for a lower power density and less heat created by the back-streaming electrons.

According to yet another embodiment of the present invention, the post can be positioned in a preferred position such as to help focus the electrons emitted from the hollow cathode 310 into a properly shaped electron beam.

In still another aspect of the invention, the post can be positioned in a preferred position such as to allow the electron beam 130 to be cut-off when the grid voltage is lowered or run at a slight negative voltage with respect to the cathode's voltage.

While this invention has been described in terms of several embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A vacuum electron device (VED) configured to host accelerated beam of electrons, the VED comprising:

a triode hollow-cathode electron gun configured to generate controllable electron beams and to substantially mitigate impact of back-streaming beam of electrons, the electron gun including:

a hollow cathode configured to emit a beam of electrons;

a heating filament configured to provide heat to the hollow cathode through a thermionic emission process;

an anode configured to attract and focus the beam of electrons emitted from the hollow cathode by maintaining a positive voltage potential relative to the cathode;

a post substantially centered relative to an axis of the hollow cathode and configured to maintain a shape and a trajectory of the emitted beam of electrons; and a hollow grid configured to control or modulate and focus the beam of electrons emitted from the hollow cathode and further configured to accommodate the post; and at least two resonant cavities configured to interact with the beam of electrons.

2. The VED of claim 1, wherein the VED is a linear particle accelerator (Linac) and the at least two resonant cavities are coupled and configured to accelerate the beam of electrons, and wherein the Linac further comprising:

an input port configured to feed a microwave power into the Linac; and an output port configured to deliver the accelerated beam of electrons out of the Linac.

3. The VED of claim 1, wherein the VED is a Linac and the at least two resonant cavities are coupled and configured to accelerate the beam of electrons, and wherein the Linac further comprising:

an input port configured to feed microwave power into the Linac; and a target configured to be bombarded by the beam of electrons and to generate X-ray photons.

4. The VED of claim 1, wherein the VED is a klystron configured to amplify microwave power, and wherein the at least two resonant cavities are configured to interact with the beam of electrons, wherein the klystron further comprising:

at least one input port configured to feed microwave power into the klystron; and at least one output port configured to deliver amplified microwave power out of the klystron.

5. The VED of claim 1, wherein the klystron is a multi-beam klystron.

6. A triode hollow-cathode electron gun configured to provide electrons and substantially mitigates the impact of back-streaming electrons, the triode hollow-cathode electron gun comprising;

a hollow cathode configured to emit a beam of electrons;

a heating filament configured to provide heat to the hollow cathode through a thermionic emission process;

an anode configured to attract and focus the beam of electrons emitted from the hollow cathode by maintaining a positive voltage potential relative to the cathode;

a post substantially centered relative to an axis of the hollow cathode and configured to maintain a shape and a trajectory of the emitted beam of electrons; and a hollow grid configured to control the beam of electrons emitted from the hollow cathode and further configured to accommodate the post.

7. The triode hollow-cathode electron gun of claim 6, wherein the hollow cathode is concave and is substantially centered on an axis of the triode hollow-cathode electron gun.

8. The triode hollow-cathode electron gun of claim 6, wherein the hollow cathode is one of a dispenser B cathode with impregnating material, a M-coated cathode and an oxide cathode, or other type of cathode and wherein the hollow cathode is configured to enhance emission of the beam of electrons.

9. The triode hollow-cathode electron gun of claim 6, wherein the hollow grid has a profile including at least one of a concave profile and a flat profile and wherein the hollow grid is placed in a close proximity, of a few mils to tens of mils, to the hollow cathode.

10. The triode hollow-cathode electron gun of claim 6, wherein the post is substantially centered on the axis of the triode hollow-cathode electron gun and is made of a suitable transition metal including at least one of Zirconium (Zr), and Hafnium (Hf), and composite metal, and wherein the hollow cathode is configured to chemically react with the cathode impregnating material to inhibit unwanted and uncontrolled emission of electrons.

11. The triode hollow-cathode electron gun of claim 6, wherein the post is substantially centered on the axis of the triode hollow-cathode electron gun and made of a low vapor pressure material including at least one of Molybdenum, and Tungsten; and wherein the post is coated with, or made from, a transition metal that is configured to chemically react with the impregnating material to inhibit unwanted and uncontrolled emission of electrons.

12. The triode hollow-cathode electron gun of claim 6, wherein the post is substantially centered on the axis of the triode hollow-cathode electron gun is a hollow cylinder configured to increase areas impacted by the back-streaming particles electrons and lower power density and heat created by back-streaming electrons.

13. The triode hollow-cathode electron gun of claim 6, wherein the post is substantially centered on the axis of the triode hollow-cathode electron gun is a hollow cone configured to increase areas impacted by the back-streaming electrons and lower power density and heat created by back-streaming electrons.

14. The triode hollow-cathode electron gun of claim 6, wherein the post is substantially centered on the axis of the triode hollow-cathode electron gun and is thermally isolated from the cathode and mechanically coupled to a heat-sink configured to keep the post material from melting.

15. The triode hollow-cathode electron gun of claim 6, wherein the post is substantially centered on the axis of the triode hollow-cathode electron gun and is positioned in a preferred position configured to help focus the electrons emitted from the hollow cathode into a properly shaped beam of electrons.

16. The triode hollow-cathode electron gun of claim 6, wherein the post is substantially centered on the axis of the triode hollow-cathode electron gun and is configured to allow the beam of electrons to be cut-off when the grid voltage is run at a slight negative voltage with respect to the hollow-cathode's voltage.

17. The triode hollow-cathode electron gun of claim 6, wherein the post is substantially centered on the axis of the triode hollow-cathode electron gun and is configured to be at a potential voltage same as the hollow-cathode to repel electrons emitted from the cathode with the same potential voltage and keep the beam of electrons from collapsing and providing for a well behaved converging beam of electrons.

18. A method for generating controllable beam of electrons while substantially mitigating impact of back-streaming of the electrons by a triode hollow-cathode electron gun, the method of generating beams of electrons comprising:

emitting electrons from a hollow cathode configured to emit a beam of electrons;

heating the hollow cathode by a heating filament through a thermionic emission process;

attracting and focusing the beam of electrons emitted from the hollow cathode by maintaining a positive voltage potential relative to the cathode on an anode;

maintaining a shape and a trajectory of the emitted beam of electrons by a post substantially centered relative to an axis of the hollow cathode; and controlling the beam of electrons emitted from the hollow cathode by a hollow grid and further accommodating the post.

19. The method of claim 18, wherein a power density on the post is lowered by shaping the post as a hollow cylinder to increase an area impacted by the back-streaming particles such as electrons.

20. The method of claim 18, wherein the power density on the post is lowered by shaping the post as hollow cone to increase the area impacted by the back-streaming particles such as electrons.

21. The method of claim 18, wherein the post is kept from melting by thermally isolating the post from the hollow cathode and mechanically coupling the post to a heat-sink.

22. The method of claim 18, wherein focusing the electrons emitted from the hollow cathode into a properly shaped beam of electrons is enhanced by optimizing the positioning of the post with respect to the hollow cathode and the hollow grid.

23. The method of claim 18, wherein allowing the beam of electrons to be cut-off when the grid voltage is run at a slight negative voltage with respect to the hollow-cathode's voltage is archived by optimizing the positioning the post with respect to the hollow cathode and the hollow grid.

24. The method of claim 18, wherein collapsing the beam of electrons emitted from the hollow cathode is prevented by keeping the post at a potential voltage same as the hollow cathode to repel electrons emitted from the cathode with the same potential voltage and hence providing for a well behaved converging beam of electrons.

* * * * *